US008607724B2

(12) United States Patent
Metwally et al.

(10) Patent No.: US 8,607,724 B2
(45) Date of Patent: Dec. 17, 2013

(54) RUDDER ASSEMBLY WITH A DEFLECTABLE TRAILING TAB

(75) Inventors: Zeyad M. Metwally, Stuart, FL (US); Maged Metwally, Stuart, FL (US)

(73) Assignee: Gyro-Gale Corporation, Stuart, FL (US)

( * ) Notice: Subject to any disclaimer, the term of this patent is extended or adjusted under 35 U.S.C. 154(b) by 322 days.

(21) Appl. No.: 13/155,162

(22) Filed: Jun. 7, 2011

(65) Prior Publication Data

US 2012/0312217 A1 Dec. 13, 2012

(51) Int. Cl.
*B63H 25/06* (2006.01)

(52) U.S. Cl.
USPC ..... 114/167

(58) Field of Classification Search
USPC ..... 114/162, 164, 165, 166, 167, 168, 169; 244/82, 87, 88, 89, 90 R, 90 A, 91, 244/99.14, 99.2, 99.3
See application file for complete search history.

(56) References Cited

U.S. PATENT DOCUMENTS

| | | | | |
|---|---|---|---|---|
| 1,582,391 | A | | 4/1926 | Flettner |
| 1,661,114 | A | | 2/1928 | Flettner |
| 2,813,689 | A | | 11/1957 | Norton et al. |
| 3,080,845 | A | | 3/1963 | Pollak |
| 3,319,594 | A | | 5/1967 | Gianoli |
| 3,678,878 | A | | 7/1972 | Ross-Clunis |
| 3,972,301 | A | | 8/1976 | Protta |
| 4,024,827 | A | | 5/1977 | Becker |
| 4,307,677 | A | | 12/1981 | Jastram et al. |
| 4,342,275 | A | | 8/1982 | Brix et al. |
| 4,463,700 | A | | 8/1984 | Becker |
| 4,510,880 | A | | 4/1985 | Kuribayshi |
| 4,535,714 | A | | 8/1985 | Petersen |
| 4,599,964 | A | | 7/1986 | Kenney et al. |
| 4,944,239 | A | | 7/1990 | McKenzie |
| 5,003,904 | A | | 4/1991 | Unger et al. |
| 5,058,521 | A | * | 10/1991 | Payne, III ..... 114/339 |
| 5,549,260 | A | | 8/1996 | Reed, III |
| 5,713,299 | A | * | 2/1998 | Lopez Ibor Alino et al. . 114/331 |
| 6,032,602 | A | | 3/2000 | Ehluss et al. |
| 6,138,598 | A | | 10/2000 | Askestad et al. |
| 6,314,900 | B1 | | 11/2001 | Samuelsen |
| 6,901,873 | B1 | | 6/2005 | Lang et al. |

* cited by examiner

*Primary Examiner* — S. Joseph Morano
*Assistant Examiner* — Anthony Wiest
(74) *Attorney, Agent, or Firm* — McHale & Slavin, P.A.

(57) ABSTRACT

Disclosed is a rudder assembly formed from a rudder structure having an airfoil shaped rudder structure rotatably secured to a shaft that is rigidly secured an underlying base plate. An upper surface of the base plate includes a support pin positioned a predetermined distance from the shaft. A trailing tab having an underlying drive plate is hingedly coupled to the rudder structure. The drive plate has a centrally located slot constructed and arranged to be slidably secured to the support pin on the base plate. Rotation of the rudder structure results in direct movement of the trailing tab in proportion to the rudder position. Clockwise rotation of the rudder structure causes the clockwise rotation of the trailing tab. Counterclockwise rotation of the rudder structure causes the counterclockwise rotation of the trailing tab.

15 Claims, 4 Drawing Sheets

RUDDER ASSEMBLY WITH A DEFLECTABLE TRAILING TAB

FIELD OF INVENTION

The present invention relates to the field of rudder control and in particular to a deflectable trailing tab mounted on the trailing edge to enhance rudder control.

BACKGROUND OF THE INVENTION

Airfoil shapes are commonly used for directional control in aircraft and marine vessels. On a marine vessel, a rudder essentially operates by deflecting water wherein the rudder moves in the direction of lower pressure as water strikes the rudder with increased force on one side and decreased force on the other side. Direction control is enhanced when a properly positioned trailing tab is employed which further reduces frictional drag thereby allowing a reduction in power necessary to move the vessel and reducing fuel consumption.

When a trailing tab is used in conjunction with marine vessel stabilizers, the efficiency of the stabilizer can also be increased. A gyroscope based stabilizer is continuously activating and positioning at least two airfoil shaped fins which project outward from the side of a vessel. In this configuration, one fin develops upward lift while the other fin develops downward lift. The combination produces a stabilizing torque which counteracts the rolling force induced by wave action.

As with any properly configured airfoil, the use of a trailing tab can further improve directional control and reduce frictional drag. The use of a trailing tab and the benefits therefrom is well known, however, the operation of the trailing tab can be improved upon by proper placement of the trailing tab driver and the elimination of complex controls.

U.S. Pat. No. 1,582,391, discloses a trailing tab for governing surfaces moving within a non-rigid medium such as water or air. The trailing tab is operated by a series of intermeshing gears to cause movement of the tab in relation to the rudder.

U.S. Pat. No. 1,661,114, discloses a device for the steering of ships by the aid of a main rudder having a trailing rudder. In the main embodiment the trailing rudder is operated by a chain or gear. In FIG. 3, a pivot point is provided by matching gear face which the service at the wheel is considerably simplified, the amount of force required in steering reduced to a fraction of that hitherto necessitated, and the steering efficiency itself essentially increased.

U.S. Pat. No. 2,813,689, discloses an articulated tab and control surface interconnected so that the articulated parts of the tab are deflected relative to each other in the same direction as they are deflected relative to the aircraft control surface which carries them.

U.S. Pat. No. 3,080,845, discloses a keel having a movable trailing tab. The keel does not rotate so the trailing tab operates as rudder.

U.S. Pat. No. 3,319,594, discloses an automatic boat steering gear which uses the reactions of the relative wind on aerodynamic surfaces exposed thereto with a trailing tab set by mechanical cable.

U.S. Pat. No. 3,678,878, discloses a self-steering arrangement for sailboats comprising a counterbalanced vane pivoted on a horizontal axis and coupled by cables to the trim tab of an auxiliary rudder.

U.S. Pat. No. 3,972,301, discloses a rudder having a trim tab. The trim tab contains a motor therein which is responsive to an electric signal such that the motor will actuate the trim tab when a signal is applied thereto such as when the ship deviates from its pre-selected course.

U.S. Pat. No. 4,024,827, discloses a vessel rudder assembly including a rudder stock bearing in the form of a cantilever beam including an internal bore through which the rudder shaft extends the rudder blade is connected to the free end of the rudder shaft, and the rudder stock bearing includes at least one rudder bearing.

U.S. Pat. No. 4,307,677, discloses a rudder having a fin which is pivotable independently thereof and with a rotor on the front edge of the rudder member and the fin between the rudder member and a guide member mounted in front of said rudder member.

U.S. Pat. No. 4,342,275, discloses a rudder assembly for marine craft wherein the main rudder carries one or more fins pivotable as well as lockable in relation to it, wherein the actuating and control devices for the fin are integrated with the rudder assembly.

U.S. Pat. No. 4,463,700, discloses a rudder for watercraft with a stabilizer articulated to the rudder blade, the stabilizer and the rudder blade being connected in articulated manner.

U.S. Pat. No. 4,510,880, discloses a ship's rudder having a flap at its trailing end, actuating apparatus for such flap comprises a sector member which is mounted on the flap at top end thereof, extending toward a rudder stock and has teeth concentric with pivot pins mounting the flap on the rudder and engaged with teeth arranged concentrically with a rudder stock on a stationary guide member surrounding the rudder stock.

U.S. Pat. No. 4,535,714, discloses an electric rudder rotor having an underwater electric motor.

U.S. Pat. No. 4,599,964, discloses a sailboat hull having a generally tapered lower hull section, whereby the lower hull section is extended rearward beneath the rudder to a point aft of the visible stern. Horizontal fins extend laterally from either side of the lower hull extension which also has a trim tab attached to its aft end.

U.S. Pat. No. 4,944,239, discloses an automatic steering control system comprising a main rudder and an active flap rudder extension on the towed vehicle controlled for independent oscillation by an active flap actuator that imparts a turning force to the flap in one direction to cause the flap and rudder to move together in an opposite direction and control means extending between the towing and a towed vehicle for automatically controlling the active flap rudder extension.

U.S. Pat. No. 5,003,904, discloses a keel assembly for a water craft having a pair of vanes spaced from and connected to the leading edge section to be disposed within a flow of water past the body. Movements of the vanes pivot the portion toward the direction of flow of the water to offset the effects of a negative pressure region occurring at the leading edge section.

U.S. Pat. No. 5,549,260, discloses a rotatable slotted cylinder, partially embedded within the contours of a tail surface, such as an aircraft tail airfoil. A longitudinal axis of the cylinder runs span wise to the airfoil at or near the three-quarter chord location. The system alters the pressures on the tail surface, thus developing lift forces necessary to counter the buffet response.

U.S. Pat. No. 6,032,602, discloses a device for guiding the flow of floating objects. The device shows a main flow body which is designed in a more flat-topped manner in the area of a leading head than in the area of a trailing end. In the flow direction, a secondary body is placed behind the trailing end, which secondary body shows a rounded cross-sectional contour. The secondary body is equipped with a flow-through recess. Furthermore, the secondary body is, regarding an axis of revolution that runs at an angle to the flow direction, guided in an adjustable manner.

U.S. Pat. No. 6,138,598, discloses a method to direct an anchored floating structure against the direction of the waves. The floating structure is provided with one or more turnable wind rudder(s) at its aft end, where said rudder(s) may be adjusted versus the direction of the wind in a manner that secures to direct the floating structure against the direction of the waves in a stable manner.

U.S. Pat. No. 6,314,900, discloses a rudder, especially for water vessels, where the main rudder blade is arranged to be in a fixedly anchored centre position with respect to the hull, and having two or more rudder flaps mounted leading and trailing on the main rudder blade and arranged to steering the vessel at high speeds, and that the main rudder blade is arranged releasable from its fixedly anchored center position, and arranged to be turnable as a whole in the usual manner, especially for steering the vessel at lower speeds.

U.S. Pat. No. 6,901,873, discloses the use of gas cavities to reduce frictional drag on underwater surfaces such as hydrofoils, struts, fins, rudders, keels, propeller blades, ship hulls, underwater bodies, and wetted surfaces in general.

SUMMARY OF THE INVENTION

The invention comprises a fin having a trailing tab that is movable in relation to the fin. A rudder assembly is formed from an airfoil shaped rudder structure rotatably secured to a hollow shaft that is rigidly secured an underlying base plate. An upper surface of the base plate includes a support pin positioned along a predetermined distance from the shaft. A trailing tab having an underlying drive plate is hingedly coupled to the rudder structure and includes a drive plate having a centrally located slot constructed and arranged to be slidably secured to the support pin on the base plate. A drive shaft extending through said hollow shape is secured to the rudder structure wherein rotation of the drive shaft produces a corresponding rotation of the rudder structure which results in direct movement of the trailing tab in proportion to the rudder position. For instance, in the preferred embodiment the support pin causes movement of the deflectable trailing tab in direct proportion to the movement of the fin (i.e. 22.5° rotation of the stabilizer fin causes and an equal 22.5° rotation of the trailing tab). Alternatively the support pin can be positioned to cause a non-equal angular movement between the rudder and trailing tab, yet maintain a proportional movement.

An objective of the invention is to provide an improvement to rudder fin control having a trailing tab that is operated upon movement of the rudder fin.

Another objective of the invention is to provide a deflectable trailing tab that is operated without a power source.

Still another objective of the invention is to provide a deflectable trailing tab based upon a strategically positioned support pin that causes movement of the deflectable trailing tab in proportion to the movement of the rudder fin.

Another objective of the invention is to provide a deflectable trailing tab having a support pin that causes movement of the deflectable trailing tab in direct proportion to the movement of the rudder fin such as a 22.5° rotation of the rudder fin causes and an equal 22.5° rotation of the trailing tab.

Another objective of the invention is to provide a deflectable trailing tab having a support pin that causes movement of the deflectable trailing tab to establish torque equilibrium.

Another objective of the invention is to provide a deflectable trailing tab that eliminates the need for electric or hydraulic movement of the trailing tab.

Still another objective of the invention is to provide a deflectable trailing tab that is compact and eliminates the need for adjustment after installation.

Still another objective of the invention is to provide a deflectable trailing tab for marine craft to complement the movement of a conventional rudder allowing for increased efficiency.

These and other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
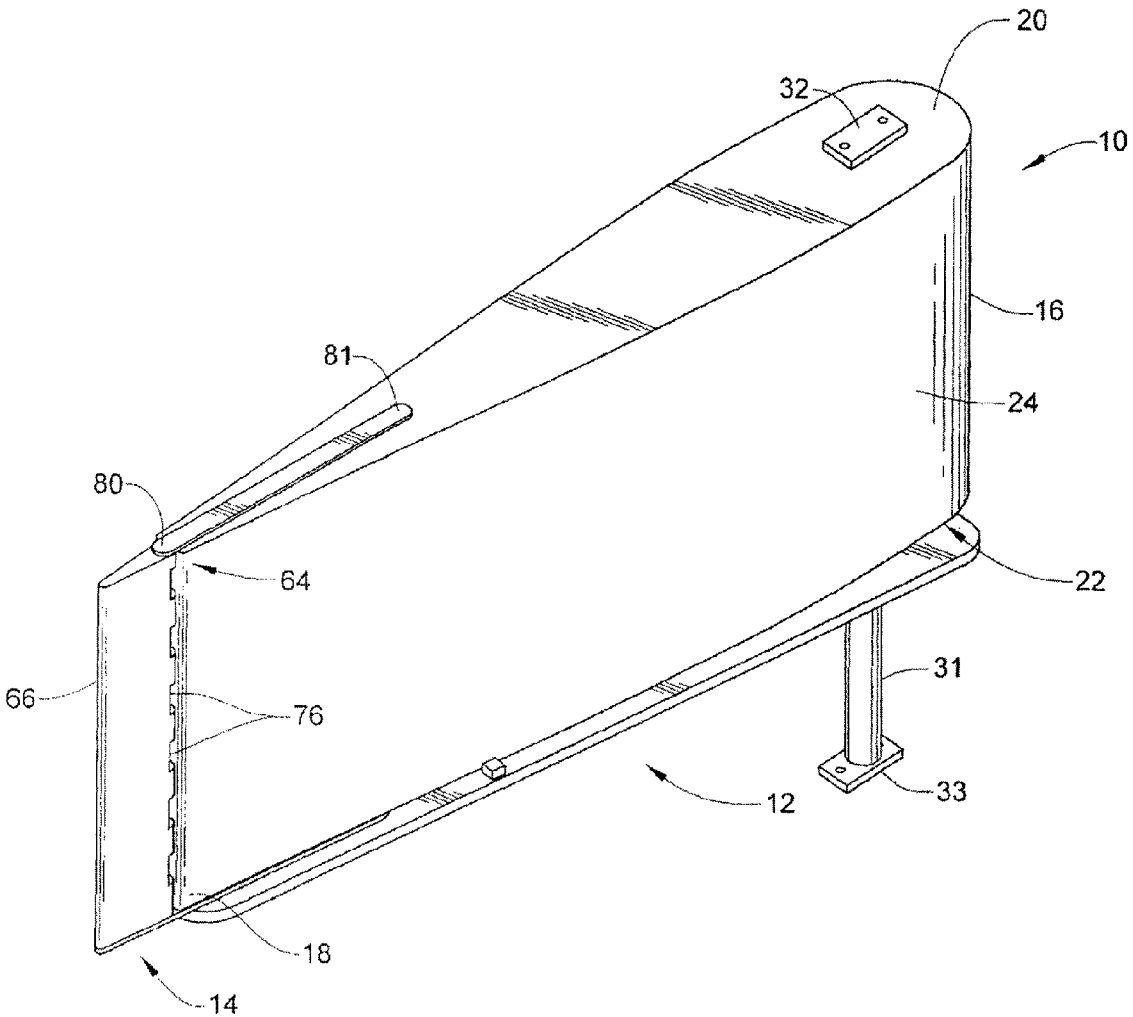
FIG. 1 is a perspective view of the instant rudder assembly with deflectable trailing tab.
Figure 2:
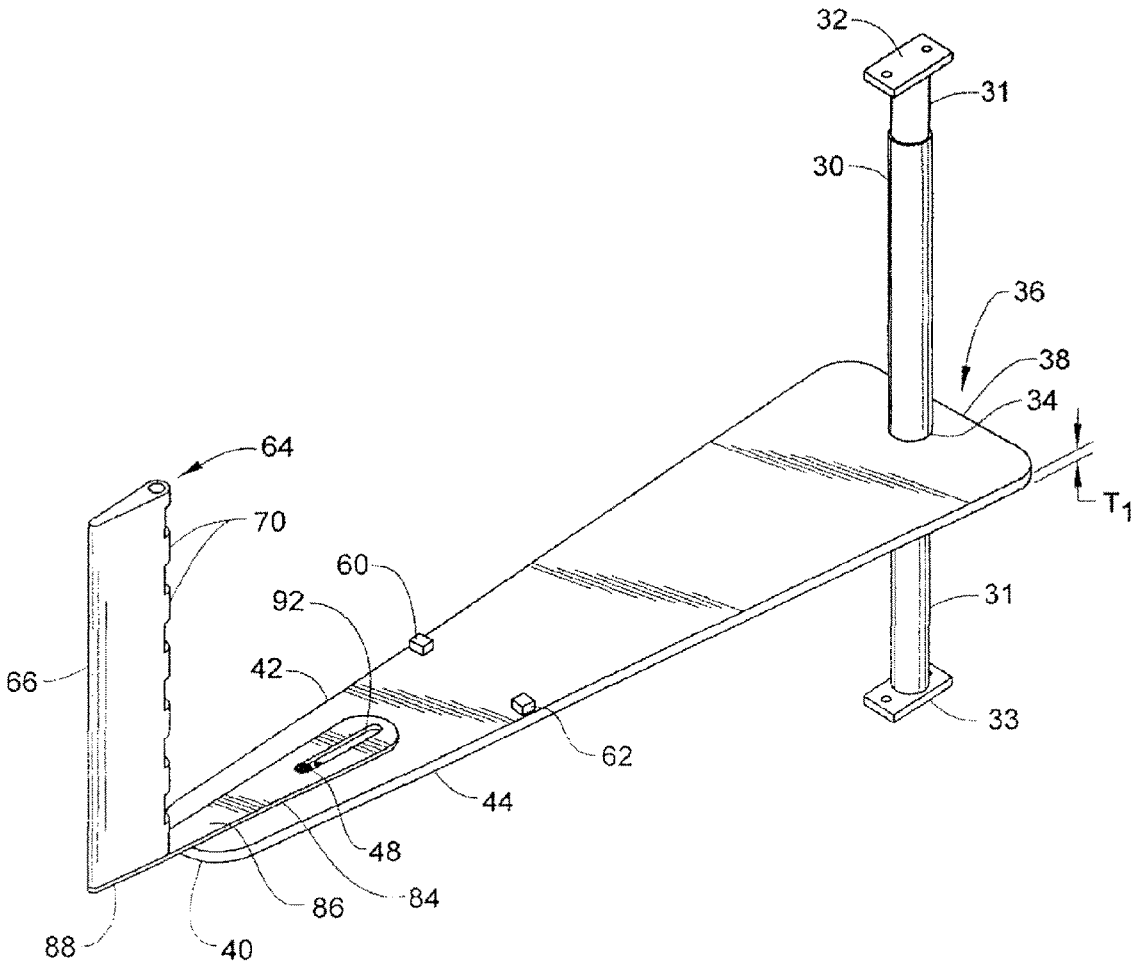
FIG. 2 is a perspective view of the base plate and drive plate engaged.
Figure 3:
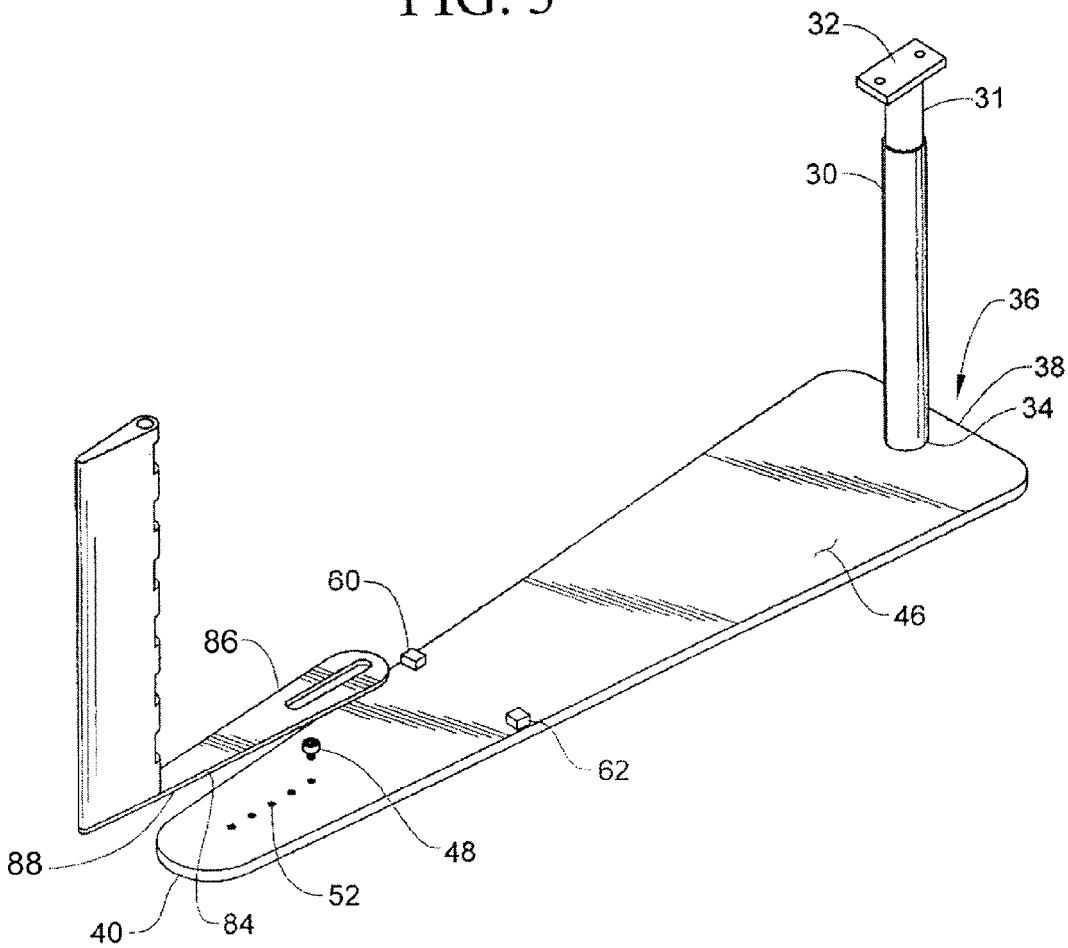
FIG. 3 is a perspective view of the base plate and drive plate separated.
Figure 4:
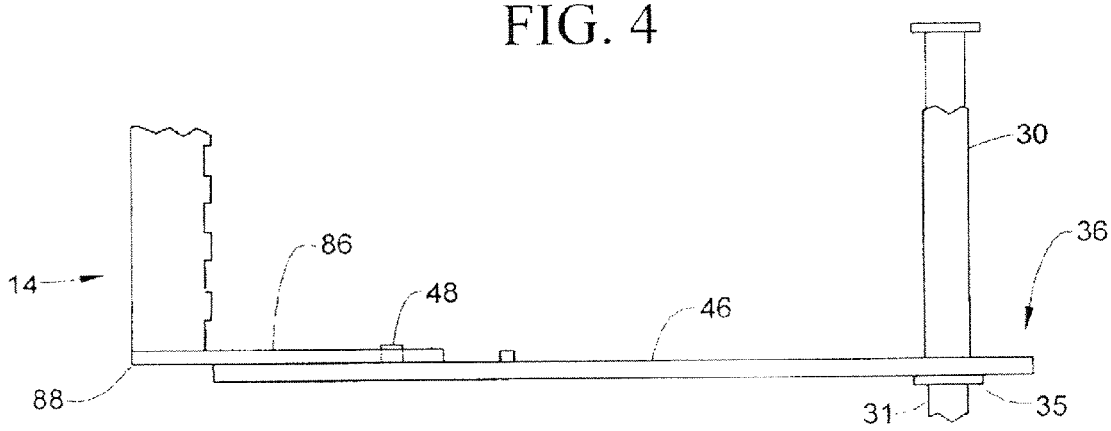
FIG. 4 is a side view of the base plate and drive plate engaged.

Now referring to the Figures in general, set forth is an embodiment of the instant invention in the form of a rudder assembly 10 consisting of a rudder structure 12 and trailing tab 14. The rudder structure has a leading edge 16 and rear coupling edge 18 with a conventional airfoil shape noted by a first width W1 along the leading edge 16 tapering to a narrower second width W2 along the rear coupling edge 18. The rudder structure is further defined by a top surface 20 and a bottom surface 22 forming the overall height of the rudder structure 12. It should be noted that the depicted rudder structure illustrates a marine use wherein the height and widths are sized for the vessel. The material of construction can be any material capable of withstanding the expected loading from use as either a main rudder assembly or a stabilizer fin. It is understood that that while a marine vessel rudder assembly is shown and described, it will be obvious to one skilled in the art that the fin and trailing edge structure can be used to improve most any airfoil structure including aeronautic applications such as the ailerons, trim tabs, fowler flaps, wind turbine blades, and so forth.

The rudder structure 12 includes an aperture which extends through the top surface 20 to the bottom surface 22 for receipt of hollow shaft 30, the rudder structure 12 is rotatable around the hollow shaft. A drive shaft 31 having a securement block 32 attached along a first end is constructed and arranged to engage the top surface 20 of the rudder structure 12 wherein rotation of the drive shaft 31 shall cause rotation of the rudder structure 12. The drive shaft 31 extends through the base plate 36 having a second end 33 available for coupling to a control gear, not shown, for rotation thereof. The drive shaft 31 may be round, hex shaped, or most any shape that allows for each of attachment to a control gear as well as the securement block 32. The hollow shaft 30 has a distal end 34 which is permanently secured to a base plate 36, preferably by a weldment and the base plate 36 includes an aperture having the same opening size as the hollow shaft 30. Alignment bearings, such as that depicted by numeral 35, may be placed along the ends of the hollow shaft to allow frictionless rotation of the drive shaft 31 within the hollow shaft 30. The base plate 36 is defined as a rigid piece of high quality steel having a thickness T1 and a length extending from a front surface 38 to a rear surface 40. Side surfaces 42 and 44 are of a width that allows rotation of the rudder structure 12 across a predetermined range of rotation which can be stopped by the drive mechanism or by the use of stop tabs 60 and 62 secured to the base plate 36 for engaging each side surface of the rudder structure.

An upper surface 46 of the base plate includes a support pin 48 which is positioned a predetermined distance from the hollow shaft 30. In the preferred embodiment the support pin 48 is positioned so as to cause an equal degree in rotation between the rudder structure 12 and trailing tab 14. However, the support pin 48 may also be moved into different locations such as those shown by support pin alternative holes 52 which are each capable of changing the degree of rotation of trailing tab 14. The support pin 48 includes a threaded bolt 51 which is used to secure the support structure 53 which can either be a bearing or a bearing surface to allow ease of base plate rotation as the support pin operates as a pivot point. The tab stops 60 and 62 which can be strategically positioned so as to prevent over rotation of the rudder structure 12. The overall size of the base plate is dependent upon the application.

The trailing tab 14 has a front coupling edge 64 and a rear trailing edge 66. In a similar manner to the rudder assembly, the front coupling edge 64 may have a width wider than the trailing tab edge 66. The front coupling edge 64 is constructed and arranged to cooperate with the rear coupling edge of the rudder structure to provide a hinged connector. The hinged connector shaped to allow laminar flow of fluid when the rudder assembly is tracking a straight line. The front coupling edge 64 is formed by the use of coupling tubes 70 that are spaced apart so as to cooperate with reciprocal coupling tubes 76 formed on the rear coupling edge 18 of the rudder structure 12. While it is noted that the coupling tubes may be formed integral to the rudder structure and trailing edge, for ease of manufacturing the use of individual coupling tubes welded to the structures provide an efficient and effective hinge formation that easily align for receipt of hinge pin 80. The hinge pin 80 is inserted into the coupling pipes 70 and 76 extends the length of the hinged connector. The hinge pin may either be secured to the drive plate 84 or maintained in position by use of a hinge pin cap 81. The trailing tab 14 is permanently secured to the drive plate 84 along surface 86. The drive plate 84 is perpendicular to the trailing tab so as to maintain the hinge pin 80 and hollow shaft 30 in a spaced apart but parallel axis position to allow for ease of rotation in respected to each other. The lower surface 88 of the drive plate 84 is slidable over the upper surface 46 of the base plate 36. Depending on the application the drive plate and base plate may be separated by a washer or the like non-friction component.

The drive plate 84 includes a centrally located slot 92 extending along the length of the drive plate and is securable to the support pin 48. The support pin 48 is positioned to allow rotation of the trailing tab 14 a predetermine amount. Positioning of the support pin 48 causes movement of the deflectable trailing tab 14 in proportion to the movement of the rudder structure. For example, in a preferred support pin 48 position, when the rudder structure rotates 22.5 degrees the trailing tab will rotate an equal 22.5 degrees. By placement of the support pin 48 into different support pin locations 52, the trailing tab 14 can be varied in degrees of rotation in relation to the rudder structure. For instance, a rotation of 22.5 degrees of the rudder structure could be made to produce only 10 degrees of movement in the trailing tab while the incremental variation remains proportional. The slot 92 can also be sized to limit rotation. In addition, coupling tubes 70 and 76 can be sized to limit rotation of the trailing tab in relation to the rudder structure.

Figure 5:
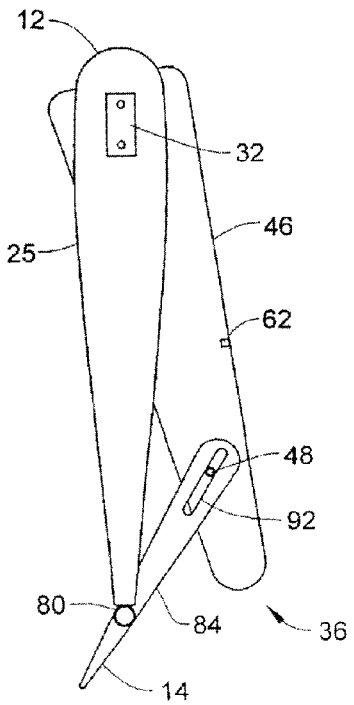
FIG. 5 is a top view of the rudder assembly in a left turning position.
Figure 6:
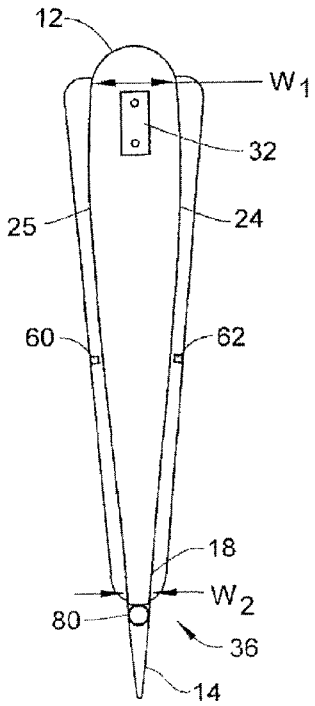
FIG. 6 is a top view of the rudder assembly in a straight position.
Figure 7:
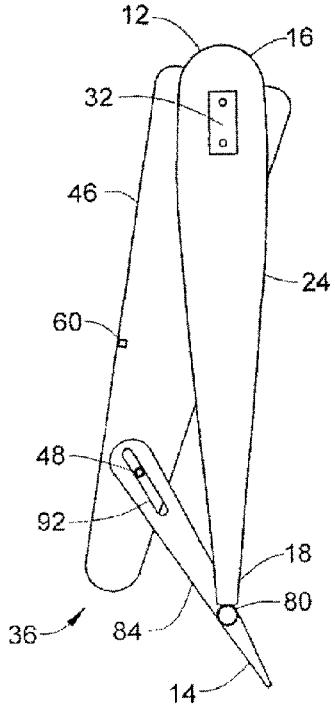
FIG. 7 is a top view of the rudder assembly in a right turning position.
Figure 8:
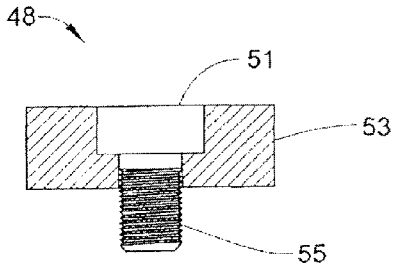
FIG. 8 is an enlarged side view of the support pin.

FIG. 5 depicts the rudder structure 12 causing deflection of the trailing tab 14 upon the directional movement of the rudder structure 12 around hollow shaft 30, a rotation caused by the steering or stabilizer drive system connecting to the drive shaft 31. Movement of the rudder structure 12 is depicted in relation to the drive plate 84 and base plate 46. The support tab 48 causes rotation of the trailing tab 14 by the movement of the rudder structure in relation to the drive plate 84 causing the slidable movement of the drive plate along slot 92. The rudder structure 12 rotation causes the deflection of the trailing tab 14 in the same direction of the rudder structure, that is, when the rudder structure rotates clockwise the trailing tab also rotates clockwise. When the rudder structure rotates counter-clockwise the trailing tab also rotates counter-clockwise. The stop tabs 60 and 62 can be used to prevent over rotation of the rudder. In this embodiment stop tab 60 will engage the rudder structure 12 along sidewall 25 to prevent over rotation of the rudder structure. It should be noted that the slot 92 may also be sized to engage the support pin 48 along an end of the slot to prevent over rotation. Further, it should be noted from this direction that the trailing tab 14 provides an improvement in the efficiency of the rudder eliminating the need for wider rudder rotation. As shown in FIG. 6, the rudder structure 12 is depicted in a straight position with leading edge 16 facing toward the front of vessel and side surfaces 24 and 25 forming the angular airfoil shape to rear coupling joint 18. In this illustration, the drive plate 84 and base plate 46 are concealed beneath the rudder structure. The trailing tab 14 is maintained in a preset alignment with the rudder structure 12 providing directional control in a straight line manner. As shown in FIG. 7 the drive shaft 31 is rotated in an opposition direction, compared to the FIG. 5 rudder structure depiction, causing displacement of the rudder structure 12 in an opposite direction in relation to the base plate 46. The support tab 48 allows movement of the trailing tab 14 by the slidable movement of the support pin along slot 92. In this embodiment stop tab 62, not shown in the figure, will engage the rudder structure 12 along sidewall 24 to prevent over rotation of the rudder structure. It should be noted that the slot 92 may also be sized to engage the support pin 48 along an end of the slot to prevent over rotation. Further, it should be noted from this direction that the trailing tab 14 provides an improvement in the efficiency of the rudder eliminating the need for wider rudder rotation. Regarding FIGS. 5-7, for ease of illustration the base plate 46 is shown in a displaced position. It is to be understood that the base plate 46 is secured in a fixed position and the rotation of the rudder structure 12 around the hollow shaft 30 causes the movement of trailing tab 14.

It will be obvious to one skilled in the art that drive shaft and the hollow shaft may have reverse functions, the interchangeability of the shafts are considered within the scope of this invention. As for a preferred embodiment, it is proposed that the use of the hollow shaft allows for a break-away feature should the rudder structure engage an underwater obstacle. A break away feature relies upon the hollow shaft to disengage to prevent damage to a vessel should it be run hard aground. The drive shaft utilized is a heavy shaft that protrudes from the hull to support and turn the rudder structure (fin). In a marine application, the heavy shaft transmit the full load of an impact to the point where the shaft enters the hull of a vessel. The break-away tube eliminates excessive stress on the hull of the vessel in the event the rudder structure is impacted.

Also, it is well understood by those skilled in the art that the seals would be used to prevent water intrusion between the shafts, when used in a marine application, the absence of the seals within the above drawings allow for simplicity of review and highlight that the rudder structure may be used in non-marine applications where seals are not required. While detailed embodiments of the instant invention are disclosed herein, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the stated claims or objectives.

What is claimed is:

1. A rudder assembly with a deflectable trailing tab comprising:

a rudder structure having a leading edge and a rear coupling edge with a top surface and a bottom surface;

a drive shaft rigidly secured to said rudder structure, said drive shaft having a first end securable to said top surface of said rudder structure and a second end extending outward from said bottom surface of said rudder structure;

a hollow shaft having a distal end and a proximal end placed about said drive shaft and through said rudder structure, said rudder structure rotatable around said hollow shaft;

a base plate having an upper surface rigidly secured to said distal end of said hollow shaft, said base plate including a support pin extending from said upper surface and positioned a predetermined distance from said hollow shaft;

a trailing tab having a front coupling edge hingedly secured to said rear coupling edge of said rudder structure and a rear trailing edge with a upper surface and a lower surface, said trailing tab having a drive plate rigidly secured to said lower surface and extending outwardly therefrom, said drive plate including a centrally located slot constructed and arranged to be slidably secured to said support pin on said base plate;

wherein rotation of said drive shaft and said rudder structure allows a proportionate deflection of said trailing tab.

2. The rudder assembly with a deflectable trailing tab according to claim 1 wherein said rudder structure includes an airfoil shaped housing having a leading edge of a first width and a rear coupling edge of a second width, said first width wider than said second width.

3. The rudder assembly with a deflectable trailing tab according to claim 1 wherein said trailing tab is includes an airfoil shaped housing having a front coupling edge of a first width and a trailing edge of a second width, said first width wider than said second width.

4. The rudder assembly with a deflectable trailing tab according to claim 1 wherein said support pin is positioned to allow a rotation of said trailing tab equal in degree to rotation of said rudder structure.

5. The rudder assembly with a deflectable trailing tab according to claim 1 wherein said support pin is adjustable to allow a rotation of said trailing tab in a degree that does not equal rotation of said rudder structure.

6. The rudder assembly with a deflectable trailing tab according to claim 1 wherein said trailing tab is hingedly secured to said rudder structure by use of a hinge pin extending a length of said trailing tab with an upper end of said hinge pin pivotally coupled to said top surface of said rudder structure.

7. The rudder assembly with a deflectable trailing tab according to claim 1 wherein said support pin and said drive shaft are aligned on a vertical axis.

8. The rudder assembly with a deflectable trailing tab according to claim 1 wherein clockwise rotation of said rudder structure causes the clockwise rotation of said trailing tab.

9. The rudder assembly with a deflectable trailing tab according to claim 1 wherein counter-clockwise rotation of said rudder structure causes the counter-clockwise rotation of said trailing tab.

10. A rudder assembly with a deflectable trailing tab comprising:

a rudder structure having a leading edge and a rear coupling edge with a top surface and a bottom surface;

a drive shaft rigidly secured to said rudder structure, said drive shaft having a first end securable to said top surface of said rudder structure and a second end extending outward from said bottom surface of said rudder structure;

a hollow shaft having a distal end and a proximal end placed about said drive shaft and through said rudder structure, said rudder structure rotatable around said hollow shaft;

a base plate having an upper surface rigidly secured to said distal end of said hollow shaft, said base plate including a support pin extending from said upper surface and positioned a predetermined distance from said hollow shaft;

a trailing tab having a front coupling edge hingedly secured to said rear coupling edge of said rudder structure and a rear trailing edge with a upper surface and a lower surface, said trailing tab having a drive plate rigidly secured to said lower surface and extending outwardly therefrom, said trailing tab is hingedly secured to said rudder structure by use of a hinge pin extending a length of said trailing tab with an upper end of said hinge pin pivotally coupled to said top surface of said rudder structure, said drive plate including a centrally located slot constructed and arranged to be slidably secured to said support pin on said base plate;

wherein clockwise rotation of said rudder structure causes the clockwise rotation of said trailing tab and counter-clockwise rotation of said rudder structure causes the counter-clockwise rotation of said trailing tab.

11. The rudder assembly with a deflectable trailing tab according to claim 10 wherein said rudder structure includes an airfoil shaped housing having a leading edge of a first width and a rear coupling edge of a second width, said first width wider than said second width.

12. The rudder assembly with a deflectable trailing tab according to claim 10 wherein said trailing tab is includes an airfoil shaped housing having a front coupling edge of a first width and a trailing edge of a second width, said first width wider than said second width.

13. The rudder assembly with a deflectable trailing tab according to claim 10 wherein said support pin is positioned to allow a rotation of said trailing tab equal in degree to rotation of said rudder structure.

14. The rudder assembly with a deflectable trailing tab according to claim 10 wherein said support pin is adjustable to allow a rotation of said trailing tab in a degree that does not equal rotation of said rudder structure.

15. The rudder assembly with a deflectable trailing tab according to claim 10 wherein said support pin and said shaft are aligned on a vertical axis.

* * * * *